United States Patent [19]

Duell

[11] Patent Number: 4,625,664

[45] Date of Patent: Dec. 2, 1986

[54] CRAFT YARNS

[76] Inventor: Virginia B. Duell, 1801 Maple, Ellis, Kans. 67637

[21] Appl. No.: 515,689

[22] Filed: Jul. 21, 1983

[51] Int. Cl.[4] ..... D05B 97/00

[52] U.S. Cl. ..... 112/262.1; 112/412

[58] Field of Search ..... 112/412, 440, 441, 438, 112/262.1, 262.2; 57/210, 243, 244, 908; 139/425

[56] References Cited

U.S. PATENT DOCUMENTS

| | | | |
|---|---|---|---|
| 711,898 | 10/1902 | Hyatt | 112/412 |
| 1,936,434 | 11/1933 | Jumonville | 112/412 X |
| 2,955,552 | 10/1960 | McGahee | 112/412 X |
| 2,961,738 | 11/1960 | Thomas | 112/412 X |
| 3,155,062 | 11/1964 | Westmijze et al. | 112/412 |
| 3,390,602 | 7/1968 | Ohno | 112/412 X |
| 3,536,019 | 10/1970 | Honda et al. | 112/412 X |
| 3,565,127 | 2/1971 | Nicely | 139/425 R |
| 3,672,148 | 6/1972 | Benson et al. | 112/412 |

*Primary Examiner*—H. Hampton Hunter

*Attorney, Agent, or Firm*—Laney, Dougherty, Hessin & Beavers

[57] ABSTRACT

A method of forming a craft yarn having unique properties and a wide variation of physical characteristics, and consisting of a selected plurality of parallel-laid yarns encased along their length by a zig-zag stitch of selected thread.

1 Claim, 4 Drawing Figures

CRAFT YARNS

BACKGROUND OF THE INVENTION

1. Field of the Invention

The invention relates generally to the formation of compound yarn products and, more particularly, but not by way of limitation, it relates to an improved form of craft yarn which is constructed by bundling a plurality of individual yarns within a zig-zag stitch.

2. Description of the Prior Art

The prior art includes numerous types of multi-yarn or multi-filament craft yarns that are constructed variously by braiding, weaving, pressing, knitting, felting, crocheting, etc. in order to construct a yarn having particularly desirable qualities for a specific decorative or functional purpose. An early U.S. Pat. No. 1,755,018 teaches an unusual form of flat rope that comprises a plurality of longitudinally extending strand wires, the number depending upon requisite flexibility, which are essentially braided along the length. U.S. Pat. No. 4,356,690 teaches construction of a fasciated yarn constructed to have a high strength, the yarn comprising a staple fiber group having specialized staple composition. The fasciated yarn includes a bundle of linearly arrayed interior fibers which are then spirally wrapped by an outer yarn. A similar type of wrap is employed on carpet tufting yarns made in accordance with U.S. Pat. No. 3,639,807 wherein metallic thread is spirally wound oppositely to the spiral lay of the fiber yarn.

Still other prior art yarns of the multi-strand filament type are represented by the teachings of U.S. Pat. Nos. 4,100,725 and 3,568,426. These teachings relate to entangled types of yarns wherein entanglement is carried out in accordance with a prior set pattern to provide a heavier and stronger product. Finally, U.S. Pat. No. 3,477,220 teaches yet another form of novelty yarn and method for making wherein the finished yarn becomes a tangled multi-filament strand, the entanglement carried out in a vortex cell.

SUMMARY OF THE INVENTION

The present invention relates to a method of constructing a unique form of craft yarn which is suitable for large scale commercial production in any of a multitude of selected sizes, strand number, resiliency and other qualities characteristic of the process. In addition, the craft yarn can be readily produced by the home economist with merely a zig-zag sewing machine or attachment, such yarn being constructible in any of the various sizes and textures for use in various craft undertakings, sewing, tailoring, millinery uses and the like. The craft yarn is constructed by selecting a plurality of individual yarns, threads, filaments, or the like for parallel lay beneath the presser foot of a zig-zag stitching mechanism. Thereafter, zig-zag stitch length and bite width are adjusted, again in accordance with desired final qualities of the craft yarn, and the zig-zag stitch is run along the bundle thereby to encase the bundle and form the craft yarn.

Therefore, it is an object of the present invention to provide a method for readily constructing a versatile craft yarn.

It is also an object of the present invention to provide a method for making an improved craft yarn using no more than sewing equipment that is normally to be found around the home.

It is yet further an object of the present invention to provide a method for forming craft yarns having diverse variation in size, rigidity, color and texture.

Finally, it is an object of the present invention to provide a readily constructible craft yarn which is versatile in usage yet vastly more economical to construct or produce in quantity than comparable yarns.

Other objects and advantages of the invention will be evident from the following detailed description when read in conjunction with accompanying drawings which illustrate the invention.

DETAILED DESCRIPTION OF THE INVENTION

Figure 1:
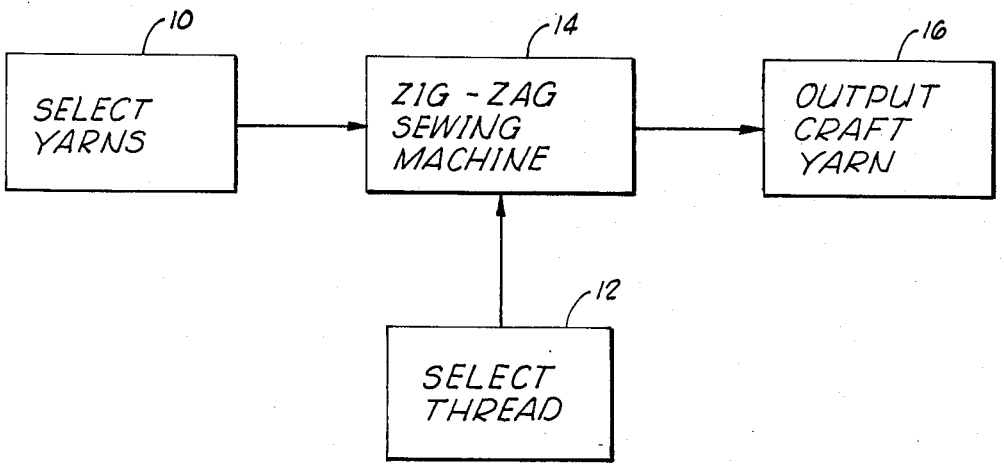
FIG. 1 is a block diagram illustrating the method steps in constructing a craft yarn in accordance with the present invention.

The present invention may be utilized, particularly by the home craftsman or hobbyist, to produce multi-filament craft yarns of a wide range of selected sizes, textures, colors and degrees of rigidity. Thus, in FIG. 1, selection of yarns at step 10 is made in accordance with the desired finally-constructed yarn. The materials available for construction of craft yarn include sewing thread, embroidery flosses, monofilament yarns, O-twist yarns, novelty yarns, knitting yarns, crocheting yarns, lightweight cords, candlewicking yarns and any of a wide number of the basic yarns or linear textile structures. Having selected a yarn, the craftsman next selects a suitable thread for zig-zag encasement of the yarns and this input is provided through stage 12 as the selected thread is threaded into the zig-zag sewing machine 14. Encasement of the yarns by the thread is carried out in the sewing machine 14 to produce the output craft yarn as indicated at stage 16.

Figure 2:
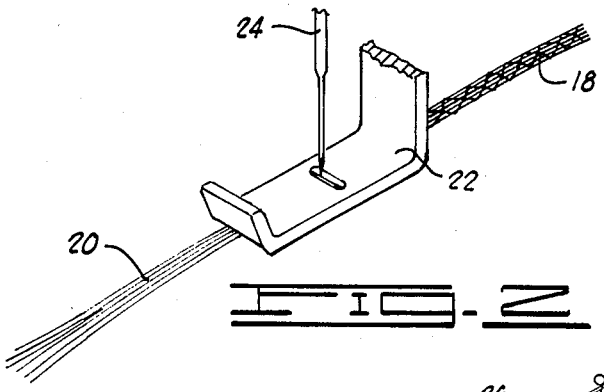
FIG. 2 is a perspective view showing a zig-zag stitch mechanism with yarn bundle being fed therebeneath.
Figure 3:
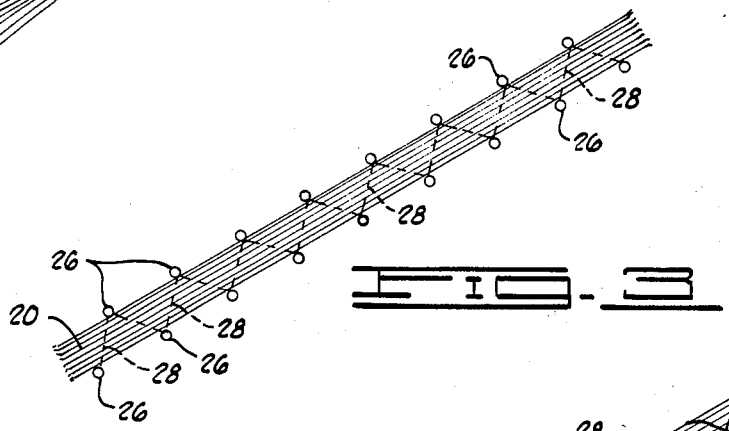
FIG. 3 illustrates schematically the layout of the zig-zag stitch length and bite relative to the encased bundle.
Figure 4:
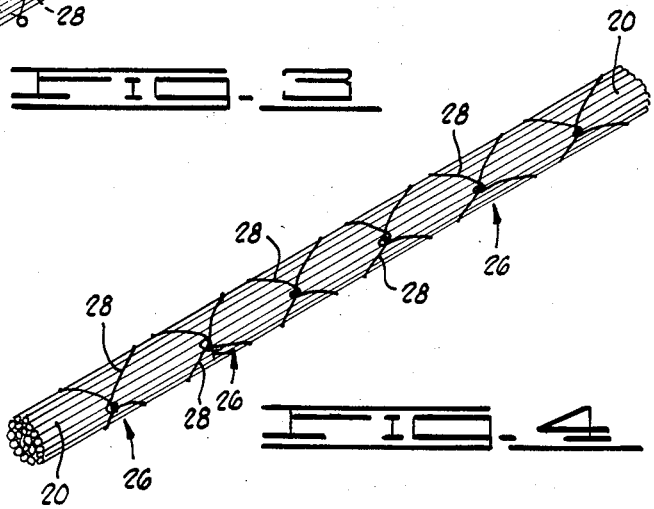
FIG. 4 is an idealized view of a portion of craft yarn constructed in a accordance with the present invention.

FIG. 2 illustrates the process during construction of a craft yarn 18 from a bundle of individual yarns 20 as they pass beneath the zig-zag presser foot 22 for encasement by opposite-side thrusts of sewing needle 24. The selected finished yarns 20 are laid parallel and then twisted slightly so that the group of yarns can be easily placed under the presser foot 22 of the sewing machine. After the group of yarns is placed under the presser foot, the foot is lowered and, with zig-zag bite and stitch length adjusted, stitching proceeds with group of yarns 20 held taut while being carried under presser foot 22 by the feed dog as the zig-zag stitching encases the yarns into a bundle forming the craft yarn 18. FIG. 3 shows schematically the progression along a yarn bundle 20 by the progressive stitch or points 26 laying the zig-zag thread 28 therealong. FIG. 4 shows more pictorially the essential craft yarn construction as the threads 28 encase the bundle of yarns 20.

Many variables are available in constructing the craft yarns. First, the selection of the basic yarn 20 may vary from a few strands of a very fine thread up to a great number, e.g. 36, 45, or greater number of thin strands, or they may be several strands of a very heavy knitting yarn or the like. The bundled yarn is then encased by the outer zig-zag thread which again may be varied widely between great limits as to color, size and type of thread. In addition to the basic yarn variables, the operator then has the choice of bite or the side-to-side needle spacing, as well as the stitch length, i.e., the longitudinal stitch spacing. Variation of the bite and stitch length is directly related to the resiliency of the craft yarn; that is, the ability of the yarn to be bent and take a set versus a generally resilient character. In any event, a large number of different forms and textures of craft yarn can be produced using the present method of construction and utilizing the wide range of variables. Generally, the stitch length control is most closely related to the final crispness of the craft yarn and its ability to be molded or shaped. During the construction, the pressure being applied by the presser foot 22 should be considered and adjusted to best accommodate the particular numbers and sizes of yarns being processed. Proper thread tension must be evident.

The foregoing discloses a novel method of constructing a craft yarn that has a large number of characteristics or attributes each of which may be varied for specific exigencies in the process of making. The craft yarn may be constructed most economically in any and all sizes and textures for use in a multitude of craft, sewing, millinery, flower decor and many other undertakings wherein cord-like material of specific size, rigidity, color and the like is required, e.g. button loops or belt loops in sewing and tailoring work. The skilled craftsman can soon learn to make craft yarn strands to fit many applications simply by adjusting the variables as to yarn texture, size and the bite and stitch length of the zig-zag encasement thread.

Changes may be made in combination and arrangement of elements as heretofore set forth in the specification and shown in the drawings;

It being understood that changes may be made and embodiments disclosed without departing from the spirit and scope of the invention as defined in the following claims.

What is claimed is:

1. A method for constructing a craft yarn having particular desired qualities comprising the steps of:

selecting a plurality of lengths of a first yarn having a first particular quality of size, color and texture;

selecting at least one additional yarn having at least one additional particular quality of size, color and texture;

forming said plurality of first yarn lengths and said at least one additional yarn into an elongated bundle of parallel-laid individual yarns;

selecting a particular stitch length and bite width on a sewing machine to obtain a desired size and resilience of a craft yarn; and tightly encasing said parallel-laid yarns with a zig-zag stitch thread.

* * * * *